US006382317B1

(12) United States Patent
Cobb

(10) Patent No.: US 6,382,317 B1
(45) Date of Patent: May 7, 2002

(54) APPARATUS AND METHOD FOR SEPARATING GAS AND SOLIDS FROM WELL FLUIDS

(76) Inventor: Delwin E. Cobb, 2323 Parana Dr., Houston, TX (US) 77080

( * ) Notice: Subject to any disclaimer, the term of this patent is extended or adjusted under 35 U.S.C. 154(b) by 0 days.

(21) Appl. No.: 09/566,364

(22) Filed: May 8, 2000

(51) Int. Cl.[7] ..... E21B 43/38
(52) U.S. Cl. ..... 166/265; 166/105.5; 96/216
(58) Field of Search ..... 166/265, 105.5; 210/512.1; 96/216

(56) References Cited

U.S. PATENT DOCUMENTS

| | | | | |
|---|---|---|---|---|
| 3,128,719 A | | 4/1964 | Jungloed et al. | |
| 4,074,763 A | | 2/1978 | Stevens | |
| 4,531,584 A | | 7/1985 | Ward | |
| 4,676,308 A | | 6/1987 | Chow et al. | |
| 4,900,433 A | * | 2/1990 | Dean et al. | 210/170 |
| 4,981,175 A | | 1/1991 | Powers | |
| 5,240,073 A | | 8/1993 | Bustamonte et al. | |
| 5,343,945 A | | 9/1994 | Weingarten et al. | |
| 5,431,228 A | | 7/1995 | Weingarten et al. | |
| 5,482,117 A | | 1/1996 | Kolpak et al. | |
| 5,525,146 A | * | 6/1996 | Straub | 96/214 |
| RE35,454 E | | 2/1997 | Cobb | |
| 5,673,752 A | * | 10/1997 | Scudder et al. | 166/265 |
| 5,711,374 A | | 1/1998 | Kjos | |
| 5,794,697 A | | 8/1998 | Wolflick et al. | |
| 5,860,476 A | * | 1/1999 | Kjos | 166/265 |
| 6,036,749 A | * | 3/2000 | Ribeiro et al. | 95/261 |
| 6,066,193 A | * | 5/2000 | Lee | 95/261 |
| 6,155,345 A | * | 12/2000 | Lee et al. | 166/105.5 |
| 6,283,204 B1 | * | 9/2001 | Brady et al. | 166/105.5 |

* cited by examiner

*Primary Examiner*—David Bagnell
*Assistant Examiner*—John Kreck
(74) *Attorney, Agent, or Firm*—Browning Bushman P.C.

(57) ABSTRACT

An apparatus and method for separating gas and solids from well fluids in a borehole including a gas-solids separator (34) having an outer tubular member (44) and an inner flow tube (46). A gas spiral housing (62) has a gas spiral (66) at its lower end positioned beneath a plurality of perforations (60) in tubular member (44). A solid spiral (70) is positioned below upper gas spiral (66) and a swirl chamber (71) is provided between gas spiral (66) and solids spiral (70). Gas separated by gas spiral (66) flows upwardly in inner gas annulus (72) to gas reservoir (74) for discharge by ball check valve (76). The solids are separated by solids spiral (70) and the clean liquid after the gas and solids have been separated flows upwardly in flow tube (46) and pipe string (14) from lower swirl chamber (80). An embodiment shown in FIG. 5 provides a shroud (27A) about a downhole motor (20A) to effect cooling of motor (20A).

21 Claims, 5 Drawing Sheets

APPARATUS AND METHOD FOR SEPARATING GAS AND SOLIDS FROM WELL FLUIDS

FIELD OF THE INVENTION

This invention relates to an apparatus and method for separating gas and solid particles from well fluids, and more particularly to such an apparatus and method in which a separator imparts a helical motion to the gas and solids for separating the gas and solids from a liquid well fluid which is pumped to a surface location.

BACKGROUND OF THE INVENTION

A pumping well is normally equipped with a string of casing, a string of tubing depending within the casing, a pump attached to the lower end of the tubing string and a gas anchor attached to the pump over the suction inlet of the pump. Oil flowing into the bottom of a well often contains large quantities of gas which, unless separated from the oil, are drawn into the pump. The displacement capacity devoted to the compression of this gas in a pump reduces its liquid capacity. Also, the power required to compress any free gas entrained with the oil drawn into an oil well pump is largely wasted. It is therefore necessary, insofar as practical, to exclude the entry of gas from the pump in order to minimize the size and initial cost of the pumping system as well as the operating and maintenance costs.

In liquid producing wells and particularly in deep producing wells where liquid is pumped to the surface, a problem is often encountered handling the gas commonly associated with the liquid in the producing formation. There is usually a substantial decrease in pressure on the liquid-gas mixture as it moves out of the liquid-bearing formation into the production well. Hydrocarbon gas, either in solution with the liquid or in the free state, expands as the gas-liquid mixture enters the production borehole. If the gas is pumped with the liquid to the surface serious difficulty is likely to be encountered with the pumping apparatus. A positive displacement pump will act as a compressor of the gas and will lose much of its efficiency in lifting liquid to the surface. In severe cases, the pump may become "gas locked" as a result of pumping gas and damage to the pump may result.

Gas and liquid separators have been utilized in order to remedy this problem. Generally, the gas and liquid separator is a device which, by utilizing the different properties of the two substances, affects the separation of the liquid which is usually a mixture of oil and water and the gas and allows them to be moved to the surface through different conduits. It should be noted, however, that separators are useful not only to separate well liquids and gas, but may also be used in separating any two fluid substances which have different specific gravities. An example of a separator other than gas and well liquid separators where the apparatus may be used effectively includes a separator for separating a gas and water mixture. Therefore, the separator described herein as primarily useful as a gas and well fluids separator, may be used to perform similar operations with no substantial alteration of the apparatus itself such as a water well.

A typical device for separating liquid and gas uses centrifugal force to assist in separating the gas form the liquid and provides an arrangement of conduits for transmitting the gas and liquid to the surface. There is still need, however, for a more efficient gas-liquid separator which utilizes centrifugal force in assisting the separation of the liquid and gas and provides a more direct and easy passage of the liquid and gas to the surface thus resulting in less pressure drop in the separator and also simpler construction.

In the production of liquid hydrocarbons from wells which are not free flowing it is common practice to use electric motor driven submersible pumps or similar type pumps with downhole motors for pumping the liquid to a surface location through a pipe string. One problem associated with the use of downhole motor driven pumps, in particular, is that the liquid being pumped can have only a limited amount of gas entrained therein without developing overheating or other operating problems which may damage the pump and generally cause unsatisfactory operation. Typically the entrained gas in the pump inlet fluid flow stream should not exceed about 15 percent by volume for best results.

Gas-liquid separators or so-called gas anchors have also been developed for downhole well pumps which force the gas-liquid mixture to undergo spiral or helical flow to effect separation of the gas and liquid due to centrifugal forces acting thereon. Various arrangements of gas-liquid separators which effect a somewhat spiral or helical motion to the fluid mixture to effect separation of gas and liquids have been used heretofore.

U.S. Pat. No. Re 35,454 reissued Feb. 18, 1997 shows an apparatus and method in which gas and solids are separated from liquids in the well fluids. A separator is provided in a tubing string below a downhole pump and spiral guide means impart a helical motion so that solid particles particularly settle downwardly. An embodiment shows particularly in FIG. 5 includes a gas separator in which gas is removed from the well fluids through vertical slots and is directed upwardly in an annulus between the spiral guide means and the inner tubular housing receiving the clean liquid after the gas has been removed from the well fluids. The separated gas is directed upwardly to a surface location through a check valve. However, with a high velocity fluid flow, a substantial amount of the gas does not enter the slots and remains with the liquid for entering the pump.

It is desired that an improved separator device be provided for the effective separating of gas and solids from well fluids for the upward flow of a clean liquid after the gas and solids have been removed.

SUMMARY OF THE INVENTION

The present invention is particularly directed to a downhole separator device on the end of a pipe string in a borehole which is effective to remove gas and solids from the well fluid so that a clean liquid product is directed upwardly to a surface location after removal of gas and solids from the well fluid. While the well fluid may be a fluid containing hydrocarbons, the well fluid may be water and the present apparatus and method is effective for water as well as hydrocarbons.

The downhole separator of the present invention is positioned on the end of a pipe string and lowered within an outer casing of a bore hole for separation of gas and solids from the well fluid. The downhole separator includes an outer tubular housing having openings therein to receive the well fluid from the annulus between the outer casing and the outer tubular housing of the separator. An inner concentric flow tube has an open lower end for the upward flow to a surface location of the clean liquid from the well fluid after gas and solids have been removed. The pipe string normally comprises production tubing and the clean liquid may be pumped upwardly through the production tubing string.

The gas and solids are removed from the well fluids in two separate steps by two separate spirals, one spiral for the gas and a separate spiral for the solids. An upper gas spiral is positioned below the openings in the outer tubular housing and a separate lower spiral spaced axially from the upper gas spiral is provided for the solids. The spirals are positioned in the annulus between the outer tubular housing and the inner flow tube. The spirals provides a helical flow and are spaced axially from each other a distance, for example, of about four (4) inches to create a swirl chamber therebetween in which the separated gas then flows upwardly normally in the outer annulus between the outer tubular housing and the casing. The gas accumulates in the swirl chamber between the spirals and is liberated from the liquid. The gas normally exists as large bubbles almost filling the area and is separated by slugs of liquid. Thus, the liquid flows downwardly in a helical path to the solids spiral.

A gas spiral housing is mounted in the annulus between the outer tubular housing and the flow tube and has spiral guides or guide members mounted on the lower end for directing the well fluid downwardly. An inner gas annulus is defined between the inner peripheral surface of the gas spiral housing and the outer peripheral surface of the inner flow tube to receive the upward flow of gas from the swirl chamber below the upper gas spiral and above the lower axially spaced solids spiral. A relatively large capacity gas reservoir is provided adjacent the upper end of the inner gas annulus to receive the separated gas therefrom. A suitable discharge control member, such as a check valve or orifice, for example, may control the flow of liquid into the gas reservoir from the annulus between the casing and the outer tubular housing of the separator.

The solids, such as sand or iron sulfide, for example, are separated from the well fluid by the solids spiral and fall by gravity into a mud anchor or other suitable collection area. The liquid then flows upwardly in the flow tube to be pumped for flow to a surface location.

An embodiment of the invention is particularly directed to a separator utilized with a downhole motor driven pump. A shroud or outer housing is provided about the motor and pump inlet so that clean liquid fluid from the separator is discharged below the motor from the pipe string and then flows upwardly within the housing about the motor for cooling the motor. The liquid after cooling the motor enters the intake for the pump for flow through the pipe string to a surface location.

It is an object of the invention to provide a downhole separator in a bore hole effective for the removal of gas and solids in separate steps in a well fluid.

A further object of the invention is to provide such a separator having separate axially spaced gas and solid spirals for the separation of gas and solids from well fluid to provide a clean liquid for upward flow to a surface location.

Another object of the invention is to provide a gas and solid's separator on the end of a production tubing in a production oil well for the separation of gas and solids from the hydrocarbon well fluid for upward flow of liquid oil in the production tubing.

A further object of the invention is to provide such a separator having a gas spiral within multiple guide members for gas and a solids spiral preferably with multiple guide members for solids to provide a relatively short length compact separator.

Another object of this invention is the provision of a shroud about the downhole motor and pump inlet to effect circulation of upwardly flowing clean liquid about the motor for cooling the motor.

An additional object of the invention is the provision of a relatively long large capacity gas reservoir above the gas spiral for the storage of separated gas therein for discharge to a surface location when the gas reaches the required pressure in the gas reservoir for return to the casing annulus.

Other objects, features, and advantages of the invention will be apparent from the following specification and drawings.

DESCRIPTION OF THE INVENTION

Figure 1:
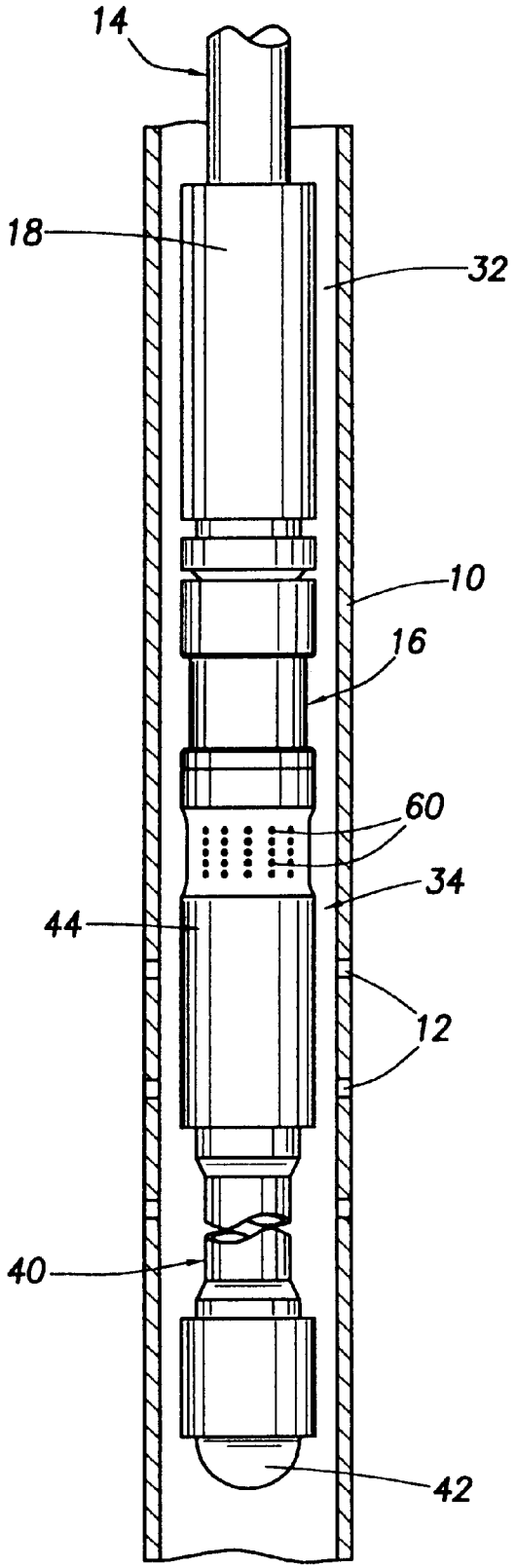
FIG. 1 is a sectional view of a tool string connected to the lower end of a pipe string mounted in a casing in a borehole and including the gas-solids separator of the present invention for the separation of gas and solids from the well fluid.

Referring now to the drawings for a better understanding of this invention, and more particularly to FIG. 1, an outer casing is shown generally at 10 positioned within a wellbore and having perforations 12 adjacent its lower end for the entry of well fluids from the adjacent formation. Mounted within casing 10 is an upper tubing string generally shown at 14 extending to a surface location and a lower tool string generally indicated at 16 supported from tubing string 14. Tool string 16 includes a downhole pump generally shown at 18 for pumping well fluids through tubing string 14 to a surface location. Annulus 32 is provided between tool string 16 and casing 10.

Mounted in tool string 16 below pump 18 is a separator or separation device shown generally at 34 and forming an important part of the present invention as will be explained. A mud anchor is shown generally at 40 forming a collection volume for solid particles beneath separator 34 and a bull plug 42 plugs the end of tool string 16. Mud anchor 40 collects sand and other solid particles and may be of substantial length such as thirty (30) to one thousand (1000) feet, for example. Sand and other solids in the well fluids from the adjacent formation enter casing 10 from perforations 12 and pump 18 pumps the clean liquid to a surface location through tubing or pipe string 14. A rod pump or a progressing cavity pump may be utilized.

Figure 2:
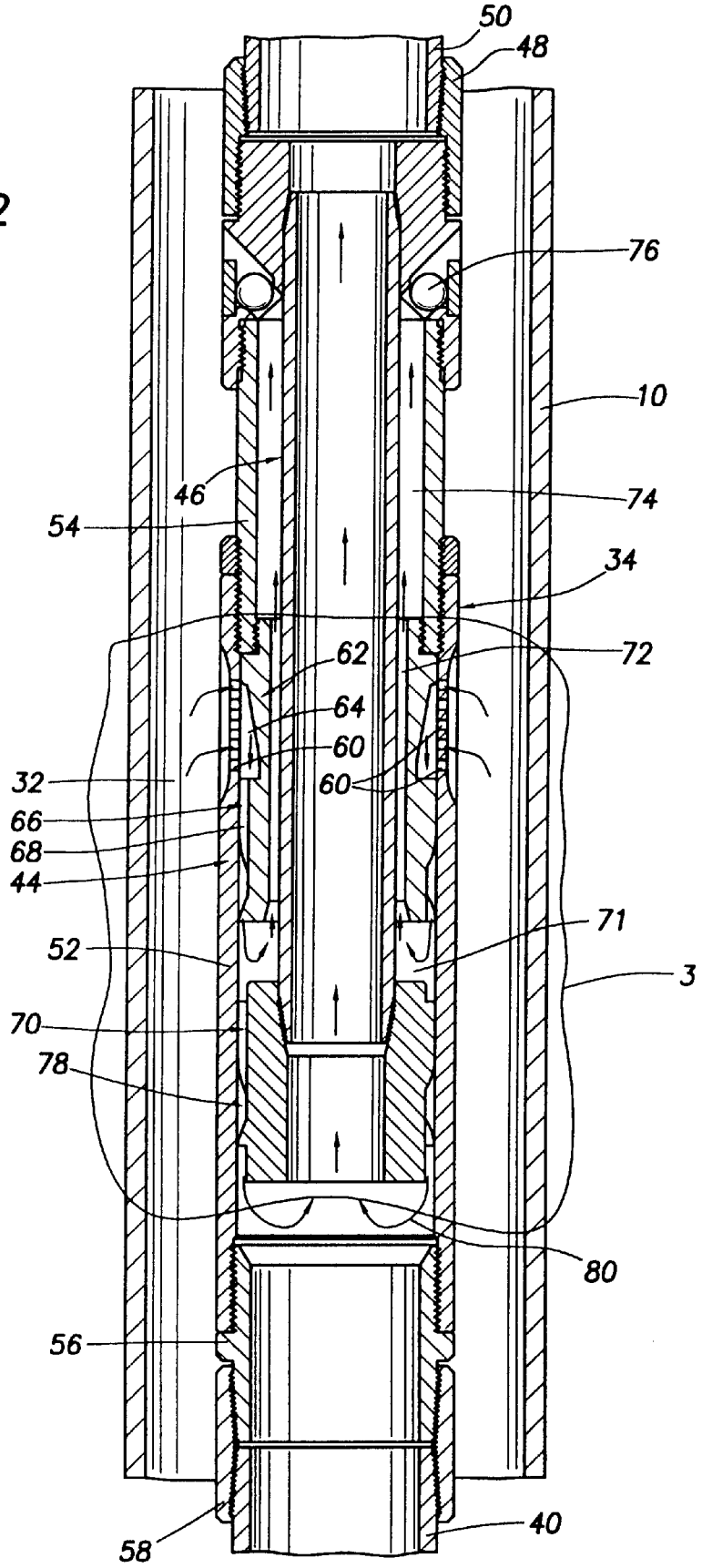
FIG. 2 is an enlarged sectional view of the downhole separator supported from the pipe string.
Figure 3:
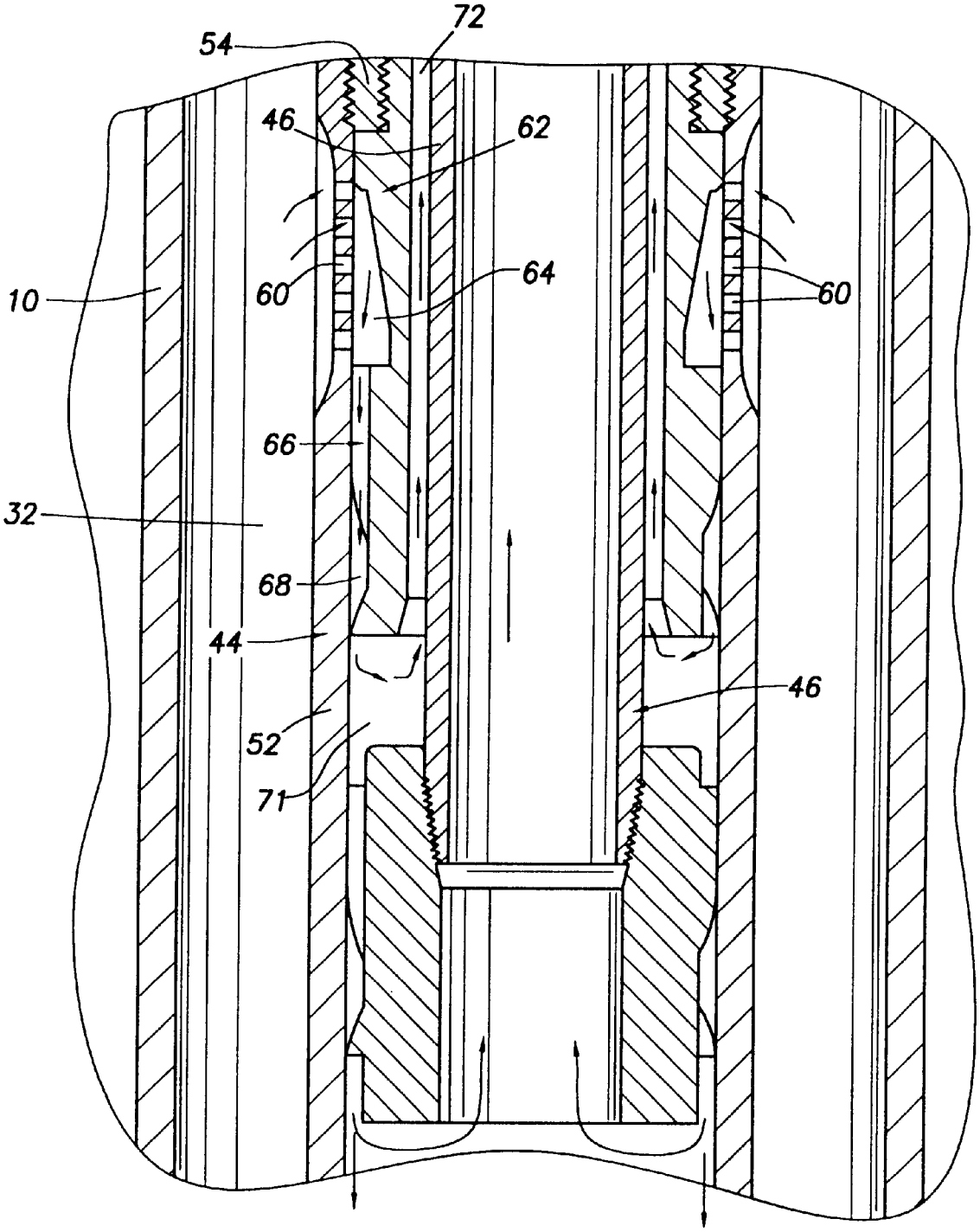
FIG. 3 is an enlarged sectional view of the separate gas and solid spirals of the separator as outlined by line 3.
Figure 4:
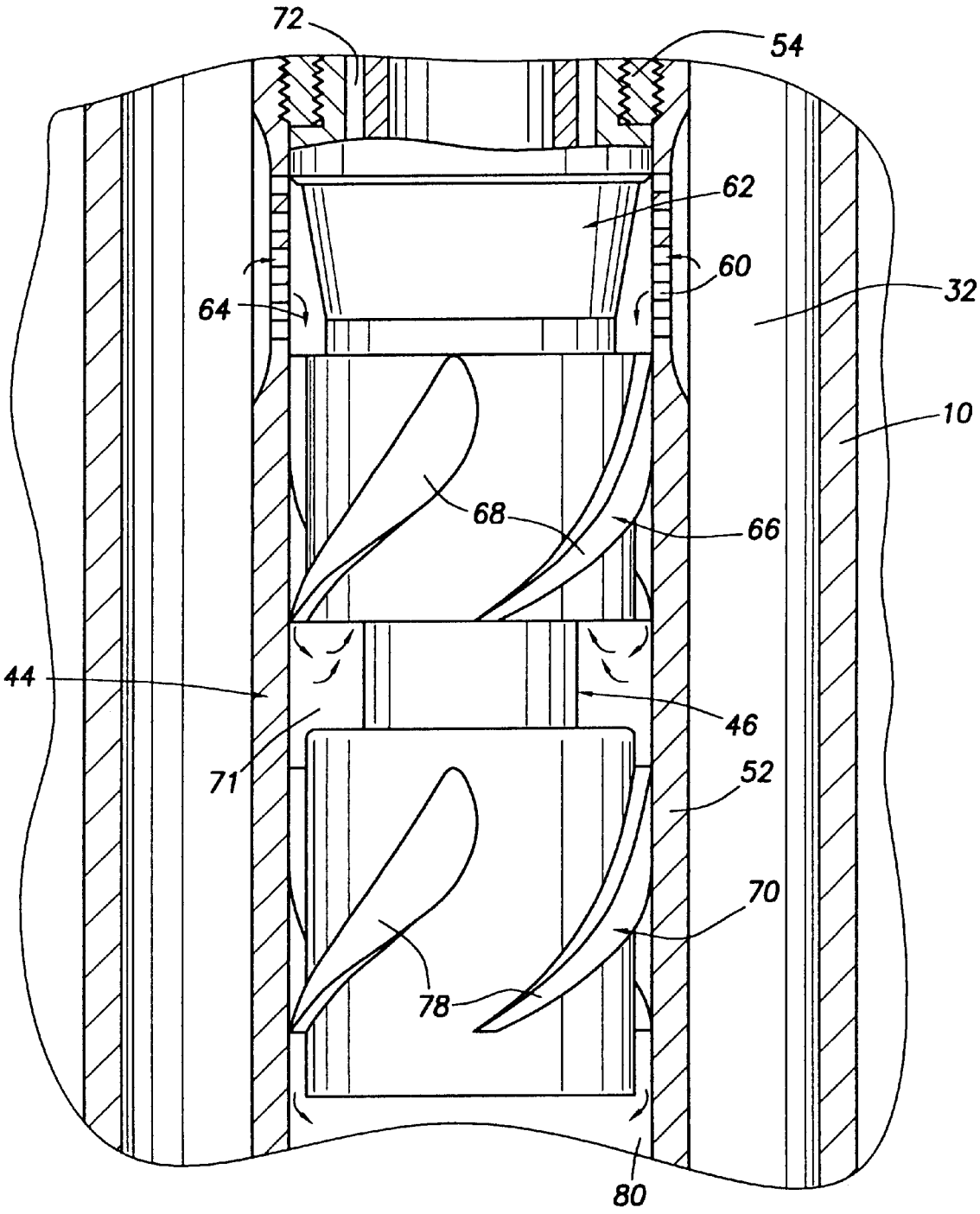
FIG. 4 is a sectional view partly in elevation of the gas and solids spirals shown in FIG. 3 and showing a plurality of spiral guide members for each of the spirals.

Referring now to FIGS. 2–4 the gas-solids separator shown generally at 34 includes an outer tubular member or housing generally indicated at 44 and a concentric flow tube or inner tubular member generally indicated at 46. Outer tubular housing 44 includes an upper coupler 48 which may be connected to a pump housing 50. Separator 34 has a generally cylindrical outer body 52 defined by outer tubular housing 44 and connected at its upper end to the lower end of a body extension 54. Separator outer body 52 is threaded at its lower end to a threaded pin 56 which is connected by a coupler 58 to a lower tubular member extending to mud anchor 40. The outer annulus 32 is defined between casing 10 and separator body 52. Lateral extending perforations 60 extend through the wall of body 52. A gas spiral housing generally indicated at 62 defines an outer well fluid annulus 64 between gas spiral housing 62 and body 52 to receive well fluid therein from annulus 32 and perforations 60. Perforations 60 act as a screen or filter to prevent large size solid particles from entering well fluid annulus 64 thereby minimizing the possibility of clogging annulus or spiral 66. For example, perforations 60 may have a diameter of about 5/32 inch.

Gas spiral housing 62 is threaded at its upper end to body extension 54. A gas spiral is indicated at 66 on the lower end of gas spiral housing 62 below perforations 60. Gas spiral 66 includes four (4) separate spiral guide members 68 mounted on the outer periphery of gas spiral housing 62 to separate to stream of wall fluid moving down annular chamber 64 into four (4) separate streams thereby permitting a relatively small length spiral to be provided. The gas in the helical downwardly moving well fluid being of a lighter density than the liquid well fluid is held against the outer periphery of gas housing 62 and moves downwardly along the outer periphery of gas housing 62 to the lower end thereof. A solids spiral 70 is threaded onto the inner peripheral flow tube 46 below gas spiral 66 and is axially spaced from gas spiral 66 about four (4) inches for example. An axial spacing between about 2 inches and 8 inches has been found to be satisfactory. A swirl chamber 71 is defined between gas spiral 66 and solids spiral 70 in which the gas changes direction from a downward direction to an upward direction and flows upwardly in an inner gas annulus 72 defined between flow tube 46 and the inner periphery of gas spiral housing 62. A gas separation chamber or area is formed by gas spiral 66 and swirl chamber 71. Gas annulus 72 is open at its lower end to permit the entry of gas from the relatively large swirl chamber 71. A relatively low fluid velocity is obtained in swirl chamber 71 to permit the gas to escape from the liquid. The relatively large upper surface formed by the solids spiral 70 restricts or blocks the gas entering the downward liquid stream.

A relatively long large capacity gas reservoir or gas chamber 74 between body extension 54 of outer tubular member 44 and inner flow tube 46 is located above gas annulus 72 for the flow of gas to gas reservoir 74 from gas annulus 72. A ball check valve 76 is provided at the upper end of reservoir 74 and upon the reaching of a required gas pressure opens to release gas from reservoir 74 for flow through annulus 32 to a surface location. Check valve 76 is also effective to restrict liquid flow from annulus 32 into reservoir 74. A length of gas reservoir 74 for continuous flow is approximately 2 feet per each psi of pressure drop through perforations 60 and gas spiral 66. In some instances, in lieu of check valve 76, it may be desirable to utilize an orifice to restrict the liquid flow to reservoir 74 from annulus 32.

After separation of gas from the well fluid in the swirl chamber 71, the well fluid with solids therein, such as sand, iron sulfide, and other solids, flows downwardly through solid spiral 70. Solids spiral 70 is sized in relation to the pumping rate and is shown as having four (4) spiral guide members 78 or vanes below and radially outwardly of the relatively large upper surface of solids spiral 70 for separating the downwardly moving well fluid into four (4) separate streams. Each spiral member extends in a helical path of about 90 degrees and the heavier solid particles are separated by centrifugal force generally against the inner periphery of the outer tubular housing 44 and then fall by gravity downwardly into outer body 52 and mud anchor 40. A lower swirl chamber 80 adjacent the lower end of solids spiral 70 permits the clean well liquid after removal of the gas and solids to change direction and move upwardly from lower swirl chamber 80 to the lower end of flow tube 46 for flow through the pipe or tubing string 14 to surface location.

A solid separation chamber or area is formed by solids spiral 70 and swirl chamber 80.

The following test results show that no measurable gas remains in the clean well liquid which is returned to a surface location in flow tube 46 and pipe string 14. Table 1 shows the test results and Table 2 shows the fluid properties of the gas and clean liquid. Thus, the test results show the effectiveness of the present invention in removal of gas and solids from well fluid.

TABLE 1

TEST RESULTS
DOWN-HOLE GAS-LIQUID SEPARATOR
(3¾ MAXIMUM O.D., 2⅞ SIZE)

| GAS FLOW RATE IN CASING ANNULUS (cu ft/hr) | LIQUID FLOW RATE THROUGH SEPARATOR (bl/day) | MEASURED GAS CARRY OVER (cu ft/hr) |
|---|---|---|
| 370 | 0 | 0 |
| 370 | 800 | 0 |
| 150 | 1600 | 0 |
| 370 | 1600 | 0 |

TABLE 2

| | FLUID PROPERTIES | |
|---|---|---|
| | VISCOSITY (centipoise) | DENSITY (lb/cu ft) |
| GAS | 0.018 | 0.071 |
| LIQUID | 0.8 | 62.1 |

Separator 34 of the present invention is highly effective in removing gas and solids from produced well liquids. Gas spiral 66 is positioned above solids spiral 70 so that a more efficient removal of solids is obtained since the gas is removed first. Any pressure loss resulting from solids spiral 70 does not affect the gas pressure in reservoir 74 for opening ball check valve 76. Swirl chamber 71 positioned between upper gas spiral 66 and lower solids spiral 70 provides sufficient space for accumulation of gas therein for upward gas flow through inner gas annulus 66 to reservoir 74. By having multiple spiral guide members on gas spiral 66 and solids spiral 70, relatively short length spirals are provided.

Figure 5:
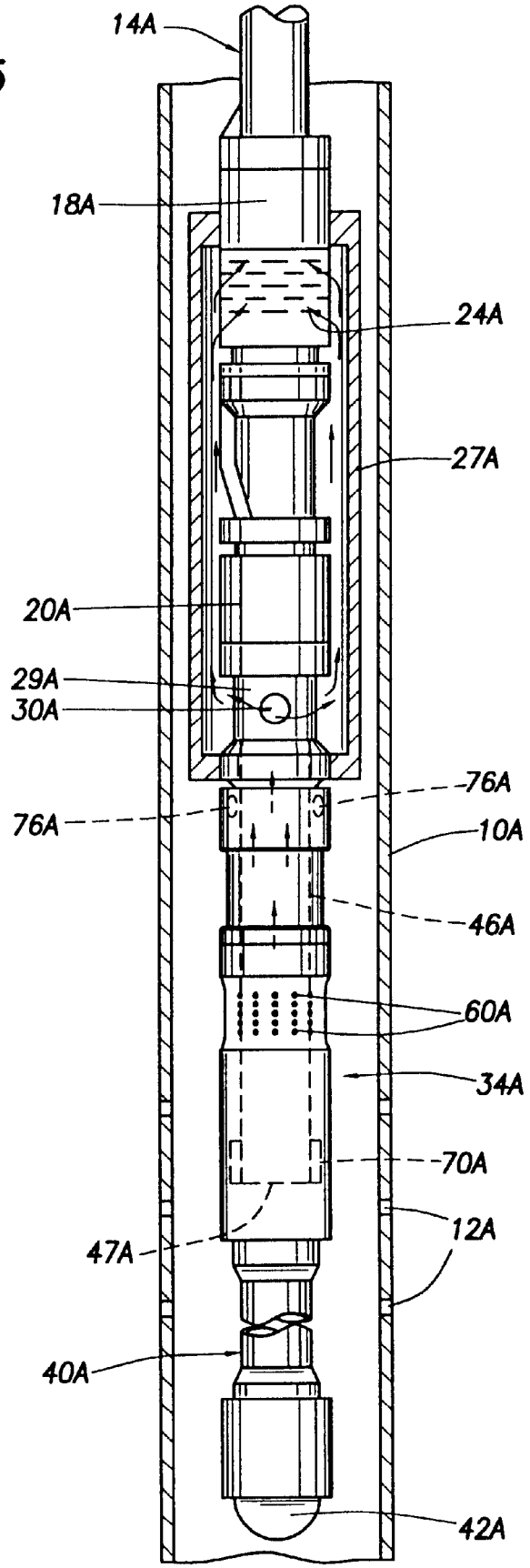
FIG. 5 is a sectional view of a modified tool string connected to the lower end of a pipe string and showing a shroud about a downhole motor for the circulation of clean liquid from the separator about the motor.

Referring now to FIG. 5, a separate embodiment is illustrated in which separator 34A is utilized in association with a downhole motor 20A and a pump 18A having a fluid intake shown at 24A. Separator 34A is generally similar to separator 34 shown in the embodiment shown in FIGS. 1–4. A casing 10A has perforations 12A therein and separator 34A is mounted on the end of lower tool string 16A supported by tubing string 14A. An annulus 32A is formed between casing 10A and lower tool string 16A. A mud anchor 40A has a bull plug 42A. Perforations 60A act as a filter for the well fluid. Clean liquid from solids spiral 70A enters the lower end 47A of flow tube 46A for upward flow.

A fluid tight shroud or housing 27A is mounted on a tool string about a downhole electric motor 20A at a location above check valve 76A. A perforated sub is shown at 29A having perforations 30A therein in fluid communication with flow tube 46A. Clean liquid from flow tube 46A is discharged from perforations 30A to flow upward about downhole electric motor 20A into intake slots 24A of pump 18A for upward flow to a surface location through tubing string 14A. The clean liquid flow is required to cool downhole electric motor 20A. Pump 18A may be a centrifical type pump or a progressing cavity pump.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A downhole separator supported from a pipe string in a borehole and positioned within an outer casing for separating gas and solids from well fluids in the annulus between the outer casing and downhole separator, said downhole separator comprising:

an outer tubular housing having openings therein to receive well fluids from said annulus;

an inner flow tube secured to said outer tubular housing and extending therefrom, said inner flow tube having an open lower end for upward flow of liquid after separation of said gas and solids from the well fluids;

a gas separation chamber between said inner flow tube and said outer tubular housing to receive said well fluids from said openings and impart a helical flow to effect separation of the gas from the well fluids;

a solids spiral spaced axially below said gas separation chamber, said solids spiral having a relatively large upper surface defining a lower end of said gas separation chamber and a plurality of vanes extending to said outer tubular housing below and radially outward of said relatively large upper surface of said solids spiral;

an inner gas passage from said gas separation chamber for the upward flow of separated gas from said gas separation chamber; and said solids spiral effecting a separation of solids from said well fluids after separation of gas therefrom with clean liquid from said well fluids being directed upwardly into the open end of said inner flow tube for flow to a surface location.

2. The downhole separator as defined in claim 1 further comprising:

a gas reservoir in an annulus between said inner flow tube and said tubular housing receiving gas from said inner gas passage.

3. The downhole separator as defined in claim 2, further comprising:

flow restriction means adjacent the upper end of said gas reservoir to restrict well fluids from flowing into said reservoir from said annulus between said downhole separator and said casing.

4. The downhole separator as defined in claim 2 wherein said downhole separator is positioned within said casing at a location below a pump for pumping liquid upwardly in said inner flow tube.

5. The downhole separator as defined in claim 2 wherein a gas spiral housing including a gas spiral is positioned between said inner flow tube and said outer tubular housing, and said gas spiral housing includes a plurality of gas spiral guides for separating said well fluids into a plurality of streams with each gas spiral guide extending in a helical path less than 360 degrees.

6. The downhole separator as defined in claim 5 further comprising:

a gas annulus between said gas spiral housing and said inner flow tube forming said inner gas passage for the flow of gas from said gas separation chamber.

7. A downhole separator as defined in claim 6 wherein said solids spiral extends between said inner flow tube and said outer tubular housing below said gas spiral housing and above said open end of said inner flow tube, said relatively large upper surface blocking downward flow of gas.

8. The downhole separator as defined in claim 1 wherein said solids spiral is threaded onto the lower end of said flow tube and provides a helical flow path for said well fluids after said gas is separated to effect separation of said solids radially outward from centrifugal force with said solids flowing downwardly in said outer tubular body and said liquid flowing upwardly in said inner flow tube after separation of said solids.

9. In a downhole tool string positioned within a wellbore and a gas separator device mounted on the end of said downhole tool string; said gas separator device comprising:

an outer tubular housing having at least one opening therein for the flow of well fluid;

an inner concentric flow tube having an open lower end for the upward flow of substantially clean liquid after the removal of gas and solids from the well fluid;

a gas spiral below said opening of said outer tubular housing to receive well fluid from said opening and impart a helical flow to effect separation of the gas from the well fluid;

a solids spiral spaced axially below said gas spiral to impart a helical flow and effect separation of solids from said well fluids in a separate step after the gas has been separated from said well fluids; and a gas separation chamber between said gas spiral and said solids spiral in which said gas separated from said well fluids moves from a downward flow to an upward flow, said solids spiral having a relatively large upper planar surface to restrict the gas entering a downward liquid stream and defining a lower end of said gas separation chamber to provide a relatively low fluid velocity in said gas separation chamber.

10. In a downhole tool string as defined in claim 9 further comprising a gas spiral housing between said outer tubular housing and said inner flow tube to define an outer annulus between said gas spiral housing and said outer tubular housing and an inner gas annulus between said gas spiral housing and said flow tube, the gas separated by said gas spiral flowing upwardly in said inner gas annulus for discharge.

11. In a downhole tool string as defined in claim 10 further comprising:

a gas reservoir between said flow tube and said outer tubular housing above said gas spiral tubular housing and receiving separated gas from said inner gas annulus.

12. In a downhole tool string as defined in claim 11 further comprising:

liquid control means adjacent the upper end of said gas reservoir to restrict fluid flow into the gas reservoir.

13. In a downhole tool string as defined in claim 10 wherein said solids spiral is removably threaded on the lower end of said flow tube and extends radially between said flow tube and said outer tubular housing.

14. A method for separating gas and solids in well fluids downhole in a borehole;

said method comprising the following steps:

providing a gas and solids separator device adjacent the lower end of a downhole pipe string with the separator device having an outer tubular member and an inner concentric flow tube, the outer tubular member defining an outer annulus between the outer tubular member and the borehole and having openings to permit the flow of well fluids from said outer annulus to an inner annulus between the outer tubular member and the flow tube;

providing a helical flow in the inner annulus to said well fluids to form a gas separation chamber;

providing a separate lower solids spiral below said gas separation chamber in axially spaced relation thereto with a relatively large upper surface of said lower solids spiral defining the lower end of the gas separation chamber between said gas spiral and said solids spiral to restrict the downward movement of gas in the liquid stream; and providing an upward flow passage for separated gas from said gas separation chamber above said solids spiral.

15. Method as defined in claim 14 further comprising:

mounting an upper gas spiral in said inner annulus to provide said helical flow; and providing an inner gas annulus between said upper gas spiral and said flow tube at a position above said solids spiral for the upward flow of gas separated by the gas spiral.

16. The method as defined in claim 15 further comprising:

providing a gas reservoir between said flow tube and said outer tubular member to receive separated gas from said inner gas annulus.

17. The method as defined in claim 14 further comprising:

providing a swirl chamber between said upper gas spiral and said lower solids spiral in which swirling gas after being separated by said gas spiral moves upwardly into said inner gas annulus for discharge.

18. The method as defined in claim 14 further comprising:

creating a swirl chamber below said lower solids spiral in which the clean swirling liquid well fluid after being separated from gas and solids moves upward in said flow tube to a surface location.

19. A method for separating gas in well fluids downhole in a borehole; said method comprising the following steps:

providing a gas separation device on the lower end of a downhole pipe string within an outer casing with the separation device having an outer tubular housing defining an outer annulus between the casing and the outer tubular housing;

mounting an inner flow tube within the outer tubular housing to define an inner annulus between the inner flow tube and the outer tubular housing, the outer tubular housing having openings communicating said inner annulus with said outer annulus;

mounting a gas spiral housing within said inner annulus to define an inner gas annulus between said gas spiral housing and inner flow tube;

mounting a gas spiral on said gas spiral housing below said openings in said outer tubular housing;

threading a separate solids spiral on a lower end of said flow tube beneath said gas spiral to define a gas separation chamber between said gas spiral and said solids spiral with a relatively large upper surface of said solids spiral restricting the downward movement of gas in a liquid stream;

directing well fluids through said openings in said outer tubular housing and along said gas spiral in a spiral path to impart a helical motion for separation of gas from said well fluids in said gas separation chamber and movement of said gas upwardly within said inner gas annulus for discharge; and then directing well fluids containing solids downwardly along said solids spiral for separation of solids from said well fluids with clean liquid well fluids being directed upwardly into said flow tube for removal from said wellbore.

20. The method as defined in claim 19 further comprising:

pumping the clean liquid well fluid separated from gas and solids upwardly through said flow tube.

21. The method as defined in claim 20 further comprising;

providing a gas reservoir for gas from said inner gas annulus; and providing liquid restriction means for said gas reservoir to block a reverse flow of liquid from said outer annulus into said gas reservoir.

* * * * *